US007293605B2

(12) United States Patent
Lee

(10) Patent No.: US 7,293,605 B2
(45) Date of Patent: Nov. 13, 2007

(54) FEED-BACK CONTROL SYSTEM FOR HEAT EXCHANGER WITH NATURAL SHEDDING FREQUENCY

(75) Inventor: Seungyoup Lee, Seoul (KR)

(73) Assignee: Bstech Co., Ltd., Seoul (KR)

( * ) Notice: Subject to any disclaimer, the term of this patent is extended or adjusted under 35 U.S.C. 154(b) by 374 days.

(21) Appl. No.: 10/491,600

(22) PCT Filed: Jul. 6, 2002

(86) PCT No.: PCT/KR02/01279

§ 371 (c)(1),
(2), (4) Date: Apr. 1, 2004

(87) PCT Pub. No.: WO03/004956

PCT Pub. Date: Jan. 16, 2003

(65) Prior Publication Data

US 2005/0115703 A1 Jun. 2, 2005

(30) Foreign Application Priority Data

Jul. 6, 2001 (KR) ..... 2001-40530

(51) Int. Cl.
*G01K 17/06* (2006.01)
*G01L 1/10* (2006.01)

(52) U.S. Cl. ..... 165/200; 165/287; 165/295; 73/861.95; 73/862.59; 374/40; 374/41

(58) Field of Classification Search ..... 165/201, 165/287, 295, 200; 374/39, 40, 41; 62/6; 73/861, 861.05, 861.95, 862.59
See application file for complete search history.

(56) References Cited

U.S. PATENT DOCUMENTS

| | | | | |
|---|---|---|---|---|
| 3,776,363 | A * | 12/1973 | Kuethe | 181/213 |
| 4,976,311 | A | 12/1990 | Kurzweg | |
| 5,026,171 | A * | 6/1991 | Feller | 73/861.95 |
| 5,316,076 | A | 5/1994 | Sandstrom et al. | |
| 6,047,602 | A * | 4/2000 | Lynnworth | 73/632 |
| 7,043,925 | B2 * | 5/2006 | Haberbusch | 62/6 |

FOREIGN PATENT DOCUMENTS

| | | |
|---|---|---|
| JP | 5 280885 | 10/1993 |
| KR | 10 0370006 | 10/2001 |
| KR | 2002 0016408 | 3/2002 |

* cited by examiner

*Primary Examiner*—Ljiljana Ciric
(74) *Attorney, Agent, or Firm*—Ladas & Parry LLP

(57) ABSTRACT

The invention relates with the feed-back control system of a heat exchanger by use of the flow resonance phenomenon which maximizes the heat transfer efficiency by generating the flow disturbances of a heat transfer medium. If a heat transfer medium is periodically stimulated at the characteristic frequency of a heat exchanger, the flow resonance frequency, which is dependent upon the flow conditions of heat transfer medium and the geometries of a heat exchanger, the disturbances of heat transfer medium is increased to the extent that heat transfer is dramatically high. This system is composed of the detecting part for the detection of flow characteristics, the processing part for the determination of flow resonance frequency, and the stimulating part which excites a heat transfer medium at the calculated flow resonance frequency.

6 Claims, 2 Drawing Sheets

FEED-BACK CONTROL SYSTEM FOR HEAT EXCHANGER WITH NATURAL SHEDDING FREQUENCY

TECHNICAL FIELD

The present invention relates to the control system for a heat exchanger, and more particularly to the flow resonance feed-back control system for a heat exchanger, which maximizes heat transfer efficiency by means of flow disturbances resulted from the continuous pulses excitation of a heat transfer medium with the same period as the detected and calculated resonance frequency of a heat transfer medium, of which function is the heat transfer in a heat exchanger.

BACKGROUND OF THE ART

A heat exchanger is used in such various fields as a heater, a cooler, a evaporator, a condenser, etc. and plays a role of supplying a target fluid with some heat and taking some heat from that fluid. The former function is carried out by a heating medium and the later by a cooling medium respectively, and the heating medium and the cooling medium is said to be a heat transfer medium in a common name.

The most used one among many types of heat exchangers is the metal tube walled heat exchanger to which a watering type, a double tube type, a fin attached multi-tube type, a shell and tube type, etc., belong. A double tube type heat exchanger has an inner tube and an outer tube, of which heat exchanging takes place between the fluid at the inner tube and the fluid at a loop shaped space between the tubes, and has a very simple structure but its capacity of heat exchanging is small.

For a large capacity of heat exchanging, a shell and tube type heat exchanger of which a large outer tube has several numbers of small tube is generally used, and, besides the aforementioned heat exchanger, there are a variety of heat exchangers.

Also, as a heat exchanging medium widely used in the industries, there are water, steam, air, exhaust gas, oil, mercury, sodium, potassium, dowtherm; a mixture of specific penyl ether and specific penyl, etc.

Up to now, heat exchangers have been developed in various aspects to increase the heat transfer efficiency, and, as a heat transfer increasing method, convection increasing method by the generation of vortices of a heat transfer medium is widely used. Convection heat transfer does not take place dynamically for a laminar flow because of its poor fluid mixing effect. So, for the promotion of convection heat transfer, a method of transition of fluid into a turbulence flow by means of acceleration of fluid is used, but the acceleration of fluid is accompanied by some disadvantages that a lot of energy and excessive components are needed and noise is produced.

Recently, a method for exciting the cooling medium flowing cooling pipes in a heat exchanger was proposed. Such a example is disclosed in the published Korean patent No. 2000-21082 issued on Sep. 25, 1998: A heat exchanger and heat exchanging method using it.

This technology in the aforementioned patent discloses a method for increasing heat transfer ratio by generating the turbulent flows resulted from the excitation of the cooling medium flowing cooling pipes in a heat exchanger by means of an exciter.

With such a method, there is an advantage of more active convection heat transfer because of the removal of boundary layer, which is made up inside the cooling pipes, of a laminar flow by means of the excitation of cooling pipes. But, for this simple vibrating method does not consider the physical properties of a fluid, increasing rate is insignificant in comparison with the energy necessary for the excitation.

According to the newly published papers, it was revealed that, when a fluid flows, there are some characteristic natural frequencies. Generally, the analysis of a fluid in a specific flow field shows that there are natural instabilities in a flow pattern of a fluid. And the analysis of such a flow pattern can show some characteristic flow resonance frequencies upon the flow conditions. Also, provided with the pulses of same frequency as the characteristic flow resonance frequency of a fluid, the flow is activated to a degree of more large amplitude by means of the resonance phenomenon.

A technology to which such a phenomenon is applied is disclosed on the published Korean patent No. 2001-3358 issued on Jun. 23, 1999; A resonance cooling device of a electronic instrument. The aforementioned technology which is applied to such a large amount of heat generating electronic instrument as a computer or a communication device is used to improve the heat radiation capacity of an electronic instrument, and, for example, a method of generation of a sine wave corresponding to the natural frequency of flow inside the case of an electronic instrument is used by a sound wave generator installed therein.

In this technology, that a natural convection accompanied closed space of a computer or a communication device is supplied with a sound wave is the core technology but, in case of the real world, the flow of natural convection in a complex closed space fluctuates very randomly, the flow resonance frequency depends on the excitation conditions, and the environments work as a important factor. So, it is very difficult to detect the flow characteristic factors which affect heat transfer to a large extent and to carry out the analysis of flow resonance frequency. Accordingly, with the present know-how, there are some limitations in the application of the aforementioned technology. Also, because sound waves are only used in the excitation of a flow, it is possible to generate a resonance phenomenon in case of a heat transfer medium of the gas, especially the air only. Accordingly, A application of the corresponding technology is limited to a heat transfer medium of the gas and to cooling the components inside the case of a computer or a communication device, where natural convection takes place, and has a disadvantage of the difficulty in applying it to a heating medium of the liquid or to forced convection accompanied heat transfer medium.

Accordingly, the heat transfer technology for the application of flow resonance phenomenon demands the deep technical measures for its application to such a general field as more complex shape condition and time-variant flow condition.

DISCLOSURE OF THE INVENTION

The invention was conceived to solve the aforementioned problems. It is the first object of the invention to propose the feed-back control system for a heat exchanger by use of flow resonance phenomenon which maximizes heat transfer efficiency by means of flow disturbances resulted from the continuous pulses excitation of a heat transfer medium with the same period as the detected and calculated resonance frequency of a heat transfer medium.

Another objects and advantages of the invention will be described hereinafter, and will be known by the embodiments of the invention. Also objects and advantages of the invention may also be embodied by the means and combinations thereof, disclosed in the claims appended.

BRIEF DESCRIPTION OF DRAWINGS

Since the following drawings appended in this specification illustrate preferred embodiments of the invention and will serve to teach more the technical spirit of the invention together with the detailed description of the invention as will be described, the invention should not be limited to and construed only as depicted in the drawings.

BEST MODE FOR CARRYING OUT THE INVENTION

Hereinafter, preferred embodiments of the invention will be described in detail with referenced to the appended drawings.

Prior to the description, it should be noted that terms and words used in the description and claims must not be limited and interpreted to be typical or literal, and should be construed as the meaning and concept conforming to the technical spirit of the invention on the basis that the inventor can define the concept of the terms and words to describe the invention in a best way.

Accordingly, since the embodiments described in the present invention and configurations shown the drawings are the most preferred embodiments only and do not represent all of technical spirit of the invention, it should be understood that there may be various equivalents and modification examples that may replace them at the time of application of the present invention.

Figure 1:
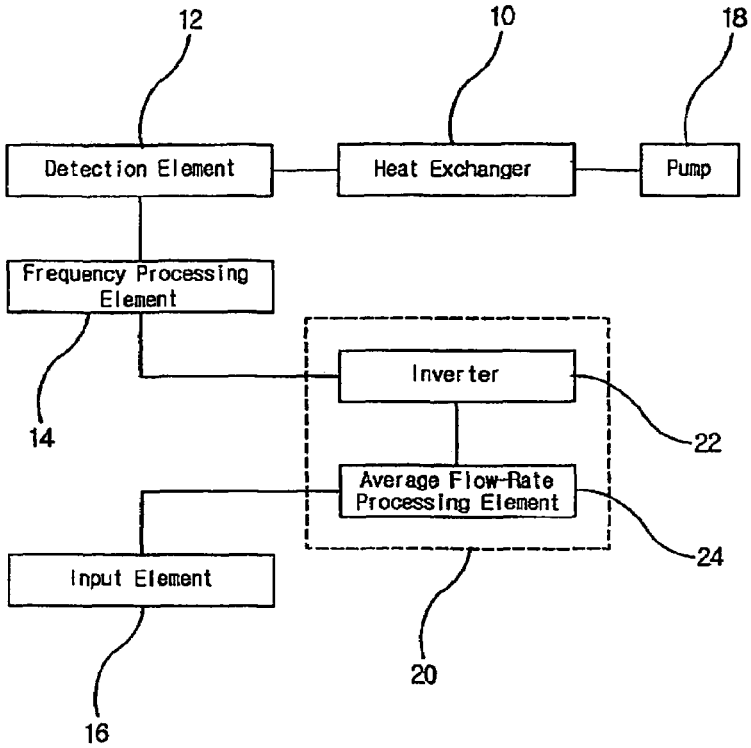
FIG. 1 shows schematically a block configuration of flow resonance feed-back control system of a heat exchanger according to the present invention.

FIG. 1 shows schematically a block configuration of flow resonance feed-back control system for a heat exchanger according to the present invention.

The flow resonance feed-back control system of the present invention is applied to a heat exchanger 10. The heat exchanger 10 is a heat exchanging instrument by generating heat transfer by means of forced convection of a heat transfer medium. A metal tube walled watering type, a double tube type, a fin attached multi-tube type, a shell and tube type, etc., can be used as a heat exchanger for the application of the present invention. Especially, a plate type heat exchanger of which large amount of heat transfer area is periodically corrugated is the most preferable.

Figure 2:
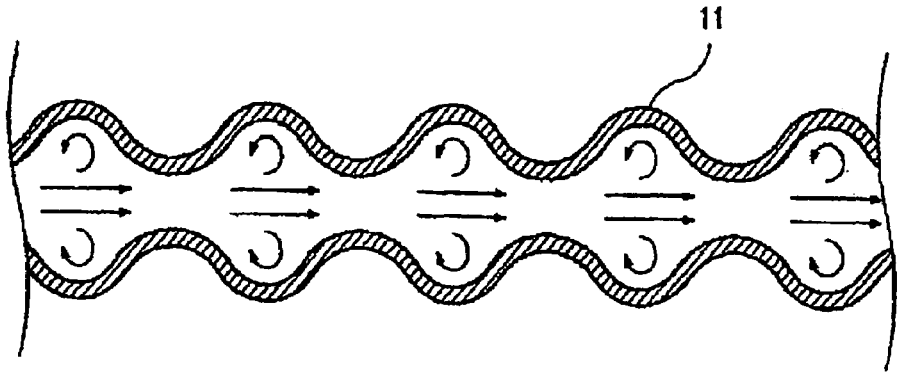
FIG. 2 shows a sectional configuration for a part of heating medium flow field in a plate type heat exchanger to which the invention was applied.

Plate type heat exchanger is generally made up with the laminated plates of some distance, and each plate has the corrugation of a constant pattern. FIG. 2 shows a sectional configuration for a part of plate in a plate type heat exchanger. A hot fluid and a cold fluid between such plates flow by turns in the vertical direction so that each plate works as a heat transfer face. At this moment, the fluid between the plates forms vortices by means of the corrugation of plates. In case of a slow flow, the stagnation of vortices between the corrugated plates hinders heat transfer. So, a method for maximizing heat transfer efficiency by means of acceleration of flow disturbances without any increase of pump power is necessary. The movement of these vortices has a constant frequency which is dependent upon the operation conditions of flow field and will be utilized for feed-back control as described in the followings.

Again, with referenced to FIG. 1, the primary embodiment of the present invention may be explained as follows.

First, a detection element 12 is installed in a heat exchanger 10. The detection element 12 detects the flow characteristics of a heat transfer medium in the heat transfer 10, where the subjects of detection are flow-rate, temperature, pressure, etc., of a heat transfer medium and another physical parameters can be detected. To measure the flow characteristics, as the detection element 12, a variety of sensors may be installed at the flow field of heat transfer medium in the heat exchanger 10 and sensors may be installed at the outlet and inlet of the heat exchanger 10. And the flow characteristics of various flow fields may be detected by means of such a non-insertion type measuring device as LDV (Laser Doppler Velocimetry).

The flow characteristics data detected with the detection element 12 is transferred to a frequency processing element 14 which calculates the flow resonance frequency of a heat transfer medium in the heat exchanger using the various flow characteristics data. At this time, as a calculation method of flow resonance frequency at the frequency processing element 14, FFT (Fast Fourier Transform) is the most preferable. Besides the aforementioned method, other methods for the rapid calculation of flow resonance frequency may be applied. FFT which is devised to reduce the calculation times during the calculation of discrete Fourier transform using approximate formula on the basis of Fourier transform is useful to rapid implementation of such a complex operation as the calculation of flow resonance frequency.

The value of flow resonance frequency calculated at the frequency processing element 14 is the criterion for the pulses which will be provided for a heat transfer medium hereafter. At this time, one time detection of flow resonance frequency of a heat transfer medium through the detection element 12 and the frequency processing element 14 can be used as a criterion but it may be possible to compute continuously the current flow resonance frequency by means of continuous detection of flow characteristics of a heat transfer medium. While the detection element 12 detects the flow characteristics of a heat transfer medium continuously, the frequency processing element 14 computes the current flow resonance frequency in real time by analyzing the flow characteristics data transferred from the detection element 12. And a pulse generating tool provides a heat transfer medium in the heat exchanger 10 with the pulses of same frequency as the current flow resonance frequency by use of the value of current flow resonance frequency computed in real time like that.

The pulse generating tool which provides a heat transfer medium in a heat exchanger with pulses can be implemented through several methods but, at the present embodiment, as an example, the method of controlling the flow-rate of a pump 18 which supplies the heat exchanger 10 with a heat transfer medium was used.

Referring to the drawing, a flow-rate control element 20 used as a pulse generating tool is connected to the pump 18 and controls the flow-rate in the form of increasing or decreasing the flow-rate of the pump 18 with the same period as the flow resonance frequency transferred from the frequency processing element 14. At this time, a inverter 22 may be used to increase or decrease the flow-rate of the pump 18, and the inverter 22 regulates rpm of a motor installed at the pump 18.

An input panel 16 for external input of operation conditions of the heat exchanger 10 may be also connected to the flow-rate control element 20. The input panel 16 is for the input of such conditions as temperature, flow-rate, pressure, etc., necessary for the operation of the heat exchanger 10, where the input data are input by an operator for himself or may be automatically input by an automatic control device.

If operation conditions of the heat exchanger 10 are input at the input panel 16, the flow-rate control element 20 determines the average flow-rate suitable to the operation conditions, and that procedure is implemented by a average flow-rate processing element 24 of the flow-rate control element 20.

The average flow-rate determined by the average flow-rate processing element 24 determines also the average rpm of a motor installed at the pump 18 and the inverter 22 increases or decreases the revolution of a motor appropriately on the basis of the average rpm.

Accordingly, a heat transfer medium in the heat exchanger 10 is provided with the pulse of same period as the flow resonance frequency by means of the flow fluctuation, which results in the abrupt increase of flow disturbances by means of the occurrence of resonance phenomenon at a heat transfer medium. Also, the increase of flow disturbances means the destruction of thermal boundary layer and the active convection so that heat transfer efficiency of the heat exchanger 10 is increased to a large extent.

Also, a set of pump may be sufficient to control the flow-rate of a pump with this component configuration but the parallel connection of two pumps or more can be used. For example, a large capacity pump which is supplied with the continuous and constant flow-rate and a small capacity pump of which flow-rate alternates periodically may be simultaneously operated. Such a configuration has the advantages of easy operation, high efficiency, and energy saving because the control of flow-rate is carried out by the small capacity pump. Also, because the installation of a pump for excitation in addition to a existing pump is enough, the aforementioned variation has very effective compatibility with the existing system.

Figure 3:
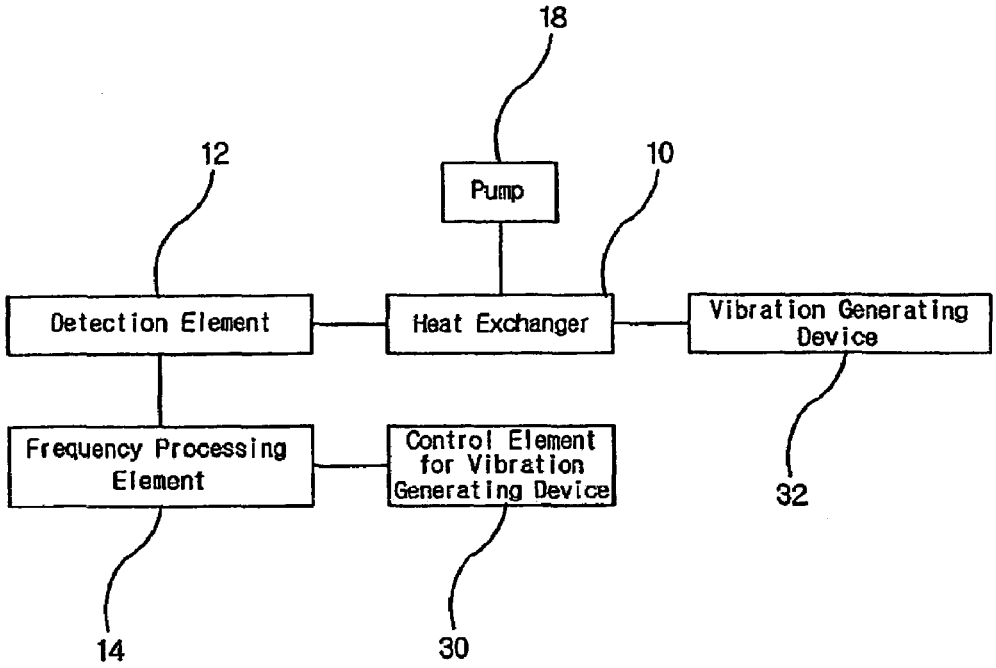
FIG. 3 shows a block configuration of feed-back control system according to another embodiment of the present invention.

FIG. 3 shows a configuration of flow resonance feed-back control system of a heat exchanger according to the secondary embodiment of the present invention. This secondary embodiment, in the aspect of pulse generating method for the heat exchanger 10, has the different configuration from the primary embodiment, and, besides the aforementioned difference, such procedures as the detection of flow characteristics and the calculation of flow resonance frequency are same as the primary embodiment described above so that its details are not described further. Also, for the components which have the same function and configuration as the primary embodiment, the same reference numbers are labeled.

Referring to FIG. 3, to provide a heat transfer medium in the heat exchanger 10 with pulses, a method that forces flow field of a heat transfer medium to vibrate was applied to the present embodiment. For that, a vibration generating device 32 is additionally installed at the heat exchanger 10, and a control element 30 for the vibration generating device is equipped with to control the excitation frequency of vibration generating device 32.

The vibration generating device 32 is to vibrate the heat exchanging faces 11 of the heat exchanger 10, and, in case of plate type heat exchanger, each heat transfer medium flowing plate is excited or each plate fixing frame is excited. Of course, a method for exciting the flow field of a heat transfer medium is not limited hereto and many other modifications can be possible.

Also, the vibration generating device 32 may comprise a electric power driven vibrator and a vibrating plate for transmission of vibrator's vibration to a heat transfer medium, and, besides the aforementioned method, a crystal vibrator or a tuning fork vibrator which is very stable against temperature fluctuations respectively, such a sine wave oscillator as LC oscillator, RC oscillator, win-bridge, linear motor, etc., a electric resonance applied molecular oscillator, a parametric oscillator by means of inductance or capacitance periodically changed by a additional alternating electric power, or laser and major may be used.

The control element 30 for the vibration generating device obtains the value of flow resonance frequency of a heat transfer medium from the frequency processing element 14 and controls the vibration generating device 32 to adjust the excitation frequency of the vibration generating device 32 with the flow resonance frequency calculated at the frequency processing element 14.

At this time, if the flow resonance frequency can be calculated by the detection element 12 and the frequency processing element 14 in real time, it is preferable that the control element 30 for the vibration generating device controls the excitation frequency of the vibration generating device 32 in real time.

As such, if an excitation with the same period as flow resonance frequency of a heat transfer medium is fed, the heat transfer medium in the heat exchanger 10 has a large amplitude by means of resonance phenomenon so that flow disturbances develop and convections are activated. Accordingly, as the preceding embodiment of the present invention, the excitation method of this embodiment can highly increase heat transfer efficiency of a heat transfer medium by means of resonance phenomenon.

Figure 4:
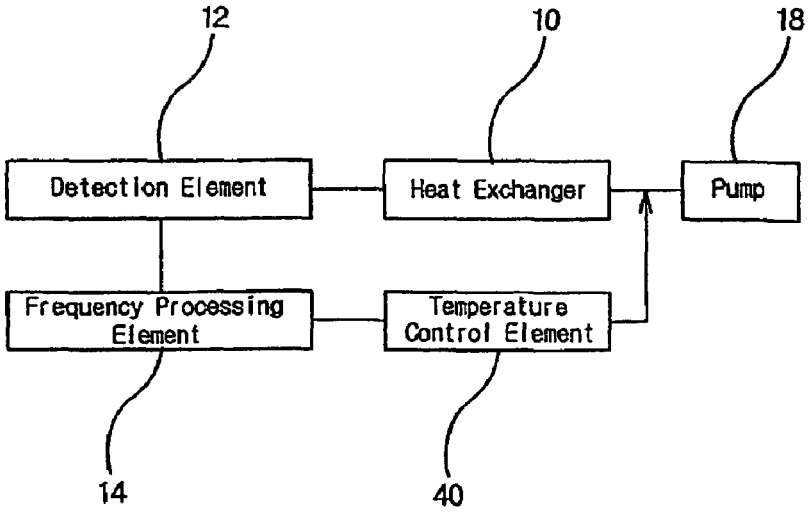
FIG. 4 shows a block configuration of feed-back control system according to the other embodiment of the present invention.

FIG. 4 shows a block configuration of feed-back control system according to the third embodiment of the present invention. This embodiment supplies the heat exchanger 10 with pulses, and controls the temperature of a heat transfer medium in the heat exchanger 10. For the components which have the same function and configuration as the embodiments described above, the same reference numbers are labeled in FIG. 4 and the detailed description thereof is omitted.

A temperature control element 40 is applied to this embodiment to supply the heat exchanger 10 with pulses. The temperature control element 40 provides the heat transfer medium in the heat exchanger 10 with pulses by use of the flow resonance frequency transferred from the frequency processing element 14. These pulses are the changes of temperature. At this time, the temperature control element 40 may control the temperature at the flow path of a heat transfer medium from the pump 18 to the heat exchanger 10, and may control the temperature at the pump 18 or at the heat exchanger.

A variety of temperature control methods of the temperature control element 40 can be applied and, for an example, Peltier Element may be used. Peltier Element absorbs or radiates some heat by an electric current, i.e., it makes use of Peltier effect that some heat is absorbed at one terminal of a joint of two metals and some heat is radiated at the other terminal according to the direction of current when an electric current is applied hereto. To be more desirable, it is more effective to adopt such a semiconductor as Bismuth (Bi) and Tellurium(Te), which have the different property of electric conductivity, instead of a joint of two metals.

Accordingly, the temperature control element 40 stimulates the heat transfer medium with an instantaneous current of same period as flow resonance frequency by use of Peltier Element and so on so that the Peltier Element makes the change of temperature according to the instantaneous radiation or absorption of some heat of a heat transfer medium by the supplied current. At this time, provided the flow resonance frequency of a heat transfer medium is continuously calculated by the detection element 12 and the frequency processing element 14, the temperature control element 40 can implement the feed-back control of a heat exchanger in real time by alternating continuously the period of change of temperature according to the value of the present flow resonance frequency.

Such change of temperature, which has the same period as a heat transfer medium in the heat exchanger 10, brings about the resonance phenomenon so that the activated convection makes the heat conductivity very high.

As described above, although the invention is described by means of defined embodiments and drawings, the invention is not restricted by them. Various modifications and variants can be made within the technical spirit and the equivalent scope of the claims which will be described in the following by those skilled in the art.

INDUSTRIAL APPLICABILITY

Flow resonance feed-back control system for a heat exchanger according to the present invention described above, by measuring the flow resonance frequency of a heat transfer medium flows resulted from the forced convection in a heat exchanger, produces pulses of same period as the flow resonance frequency thereof so that the highly activated disturbances of heat transfer medium, the destroyed thermal boundary layers, and the highly activated convections result in the maximization of heat transfer efficiency.

Such flow resonance feed-back control system can be applied to all devices where the heat transfer efficiency can be improved by the fluid disturbances, especially very high performance improvement is achieved in case of a forced convection type heat exchanger which uses the liquid or a mixture of the liquid and the solid as a cooling medium or a heating medium, and, to be more desirable, the effect is maximized in a plate type heat exchanger.

What is claimed is:

1. In a control system for a heat exchanger of in which heat exchanging is resulted from a forced convection of a heat transfer medium, a flow resonance feed-back control system of a heat exchanger comprising;

a detection element for detecting the flow characteristics of a heat transfer medium, the detection element being located at the aforementioned heat exchanger;

a frequency processing element for calculating the flow resonance of a heat transfer medium by analyzing the flow characteristics detected by the aforementioned detection element; and a pulse generating element for providing the heat transfer medium in the heat exchanger with a pulse of a same period as the value of the flow resonance frequency calculated at the aforementioned frequency processing element, characterized in that the pulse generating element is a flow-rate control device which controls a flow-rate of a pump for providing the heat exchanger with a heat transfer medium with the same period as a flow resonance frequency input from the frequency processing element.

2. The flow resonance feed-back control system of a heat exchanger as claimed in claim 1, characterized in that the flow-rate control device comprises an average flow-rate deciding element for determining an average flow-rate according to an already established operating condition; and an inverter for controlling a motor rpm of the pump to increase or decrease the inlet flow-rate of a heat transfer medium with the same period as the flow resonance frequency input form the frequency processing element.

3. The flow resonance feed-back control system of a heat exchanger as claimed in claim 1, characterized in that the pulse generating element comprises a vibration generating element for exciting heat transfer faces of the heat exchanger; and a vibration control element for controlling the excitation period of the vibration generating element according to the flow resonance frequency calculated by the frequency processing element.

4. The flow resonance feed-back control system of a heat exchanger as claimed in claim 1, characterized in that the pulse generating element is a temperature control type element for controlling an inlet temperature of a heat transfer medium of the heat transfer to adjust to the same period as the flow resonance frequency.

5. The flow resonance feed-back control system of a heat exchanger as claimed in any one of claims 1 and 2 through 4, characterized in that the detection element detects the flow characteristics of a heat transfer medium continuously, the frequency processing element calculating the present flow resonance frequency in real time using the flow characteristics data transferred from the detection element, and the pulse generating element provides the heat transfer medium of the heat exchanger with pulses of the same period as the present flow resonance frequency transferred from the frequency processing element.

6. The flow resonance feed-back control system of a heat exchanger as claimed in claim 5, characterized in that the heat exchanger is a plate type heat exchanger.

* * * * *